United States Patent [19]

Lechner

[11] Patent Number: 5,027,564

[45] Date of Patent: Jul. 2, 1991

[54] BUILDING CONSTRUCTION WITH A CHAMBER WHICH CAN BE ACTED UPON BY A FLUID MEDIUM

[75] Inventor: Rudolf Lechner, Singen, Fed. Rep. of Germany

[73] Assignee: Colux Gesellschaft für Licht - und Leichtbau mbH, Singen, Fed. Rep. of Germany

[21] Appl. No.: 347,759

[22] Filed: May 4, 1989

[30] Foreign Application Priority Data

May 9, 1988 [DE] Fed. Rep. of Germany ... 8806173[U]

[51] Int. Cl.[5] ..... E04B 1/345

[52] U.S. Cl. ..... 52/2.23; 52/63; 52/83; 52/222

[58] Field of Search ..... 52/63, 83, 2 G, 2 J, 52/222, 273

[56] References Cited

U.S. PATENT DOCUMENTS

| | | | |
|---|---|---|---|
| 2,986,150 | 5/1961 | Torian | 52/63 |
| 3,791,076 | 2/1974 | Gahler | 52/2 G |
| 4,452,230 | 6/1984 | Nelson | 52/2 J |
| 4,583,331 | 4/1986 | Hunt et al. | 52/2 G |
| 4,642,962 | 2/1987 | Walter | 52/63 |
| 4,807,405 | 2/1989 | Borgquist | 52/81 |
| 4,878,322 | 11/1989 | Ikeda et al. | 52/2 |

FOREIGN PATENT DOCUMENTS

| | | | |
|---|---|---|---|
| 2052864 | 3/1972 | Fed. Rep. of Germany . | |
| 2228389 | 6/1973 | Fed. Rep. of Germany . | |
| 2724373 | 11/1978 | Fed. Rep. of Germany | 52/2 J |

*Primary Examiner*—James L. Ridgill, Jr.

*Attorney, Agent, or Firm*—Bachman & LaPointe

[57] ABSTRACT

A building construction, in particular a roofed-over hall, has a lattice-type space framework and at least one flexible skin secured thereto as a means defining a chamber (25 or 26) which can be acted upon by a fluid medium and which has at least one inlet/outlet for the fluid medium. Foil webs (22, 23, 24) of translucent plastic material are fixed in superposed relationship between adjacently extending frame members (14) of the framework and form between the two frame members (14) air-tight chambers (25, 26) extending to the frame members. One chamber (25) can be filled with stationary inflation medium and the flow medium can flow through the other chamber (26) between the inlet and the outlet.

25 Claims, 4 Drawing Sheets s
k2
k1
14
21
22
23
24
28
29
30
31
32
34
35
36
38
40
41
42
43
44
46
47
48
48a
49
50
51
52

14
22
23
24
25
26
27
28
30
31
35

27a
27b
27c
14
22
23
24
25
26
28
35
54
54a
55
56
58
60
62
64
66
67
68
69
43a
49a
51a
x
y
z

BUILDING CONSTRUCTION WITH A CHAMBER WHICH CAN BE ACTED UPON BY A FLUID MEDIUM

BACKGROUND OF THE INVENTION

The invention relates to a building construction, in particular a roofed-over hall, comprising a lattice-type space framework and at least one flexible skin which is secured thereto as a means defining a chamber which is acted upon by a fluid medium.

A building construction of that kind is known from German published specification (DE-AS) No. 2 228 389, in the form of a cushion provided with inlets and outlets for the gaseous fluid medium, for being filled with an inflation medium which is kept at an internal pressure that differs from atmospheric pressure, the cushion being secured to framework cables and frame members. A plurality of such cushions form a common roofing configuration. The object of the previous invention was to overcome the disadvantages of support constructions consisting of continuous bars for individual skins which are fixed for example to the surface of the carrier construction, or for pneumatic elements which are stiffened and braced by a rigid internal framework.

In the case of building constructions having a plurality of cushions which are fitted together, on the one hand the expensive assembly operations have been found to be a disadvantage, but a greater disadvantage is the absence of the necessary sealing zones. In addition the cushion-type roof disclosed in DE-AS Nos. 2 228 389 or 2 052 864 did not comply with the requirements in regard to the amount of light in the interior of the building.

In consideration of those aspects the inventor set himself the aim of providing a building construction of the kind discussed above which eliminates the disadvantages found in the state of the art and which in particular is to be suitable for roofing over swimming baths, plant-growing areas and the like, with advantageous conditions in respect of light in the interior of the construction.

SUMMARY OF THE INVENTION

That object is attained in that two foil webs of preferably translucent plastic material are fixed in superposed relationship between adjacently extending frame members of the framework and form between the two frame members an air-tight chamber which is elongated in a strip-like configuration.

In accordance with a further and particular feature of the invention, a central foil also extends between the two foil webs and separates from each other two chambers which can be acted upon by air. By virtue of the increased pressure in the chambers, the foil webs are tensioned and made resistant to fluttering, as the state of the art also teaches. Transverse cables which apply a loading to the outer foil, in accordance with the invention, protect the air chambers which are in the form of elongated spherical triangles or rectangular cushion webs, in particular form forces due to reduced pressure or suction effects.

Constructions have been found to be advantageous, in which the outer chambers are filled with stationary air and the inner chambers are filled with the moving fluid medium, the latter circulates between the inlet and the outlet and may also be preheated. That prevents any condensation in the inner chamber; condensate which possibly occurs in the outer chamber, in an amount of about 15 g per cubic meter is negligible.

The inlets and outlets may be disposed both in the longitudinal direction of the strips and also transversely with respect thereto, at spacings from each other, the optimum length of the flow path in the interior of the cushion being the determining consideration in that respect.

It has also been found advantageous to produce a layer of heated air at the inward surface of the cushion construction, for example by means of blowing nozzles which are disposed adjacent the inner foil.

In accordance with an embodiment of the invention the frame members are fixed at one end towards the ground for example on beams or purlins and extend towards a connecting elements which is arranged at a spacing relative to the ground and to which they are connected at their other end; the preferred form of the building construction is dome-like or hemispherical. The frame members are secured to the ground in a circular configuration and are curved to a central roof ring, forming a part-spherical frame structure. Those frame members are the main supports or spars of the building frame structure and are advantageously connected together by transverse bars. Diagonal bracings may engage approximately the corner points of the panels defined by the frame members and the transverse bars, to provide a better stiffening effect.

In accordance with the invention, in order to simplify the structure and to provide a better sealing effect in respect thereof, each foil web is air-tightly secured releasably to connecting members of the frame members, by the two longitudinal edges of the respective foil web but possibly also at the narrow sides thereof.

For that purpose, it has been found to be advantageous for a channel profile to be fixed on the frame member, the channel profile extending thereon in the longitudinal direction thereof, or transversely with respect thereto, while a respective extruded connecting member may be mounted to the longitudinal edges of the channel member. In certain constructions however the connecting members may also bear directly on the frame member.

The channel member or a connecting member of corresponding shape carries away the rain water between each two of the elongated chambers, while in addition the connecting members permit the foils to be air-tightly connected in position, and also replacement thereof, in a beautifully simple fashion.

Advantageously, a further connecting member is secured to the frame member at a spacing relative to the upper edge of the first connecting member, for determining the spacing of the foils from each other. The further connecting member has at least one upwardly open groove of an undercut configuration as well as an upwardly facing channel portion which adjoins same at an angle with respect thereto, for receiving and draining away condensate which possibly occurs at the edge of the chamber.

Another advantageous embodiment of the connecting member is provided with at least two grooves of an undercut configuration and which extend at a spacing from each other, preferably in the form of an angle portion with a respective groove associated with each limb thereof. That connecting member is releasably arranged on the frame member whereas, as stated, the other connecting member extends away from the rain water drain.

To facilitate handling, a respective clamping member is provided in each of the undercut grooves of the connecting member or members, the clamping member air-tightly fixing the inserted edge of the foil in the groove of the undercut configuration. The clamping member may also extend in the form of a retaining bead in the foil web.

The fact that the frame members are fitted with the connecting members permits the foil web to be installed quickly and in an air-tight fashion; with an increasing internal pressure, the foil web bears increasingly tightly against the walls of the grooves.

In accordance with the invention, projecting from the frame members are fixing screws on which are mounted the transverse cables which partially bear against the outer foil, preferably being connected to a wing lug on the fixing screw.

Holding the foil in position in the above-described manner very substantially prevents the occurrence of condensation in the interior of the chambers.

The material for the foils is a modified ethylenetetrafluoroethylene copolymer; that flame-resistant foil is highly transparent and resistant to weathering. The translucency in the visible light range is for example from 94% to 97% (total light) in the case of a 100 μm foil, while transmission in the ultra-violet range (320 to 380 nm) is 83% to 88%. The foils have a thickness of from 50 μm to 250 μm.

That foil has a very high level of transparency to ultra-violet in the spectral range of solar radiation. That not only permits optimum plant growth beneath the roofing, but also permits bronzing of human skin in a way that corresponds to the conditions in the open air.

In addition the foil has a high degree of absorption in the infra-red range (heat retention capacity). It does not absorb water and it is resistant to solvents and chemicals as well as being dirt-repellent.

The k-value in accordance with DIN 4108 of a cushion or skin panel which is made up in a compartmented configuration with three foils is better than about 1.96 $W/m^2$ K.

Further advantages, features and details of the invention will be apparent from the following description of preferred embodiments and with reference to the drawings, in which:

DETAILED DESCRIPTION

Figure 1:
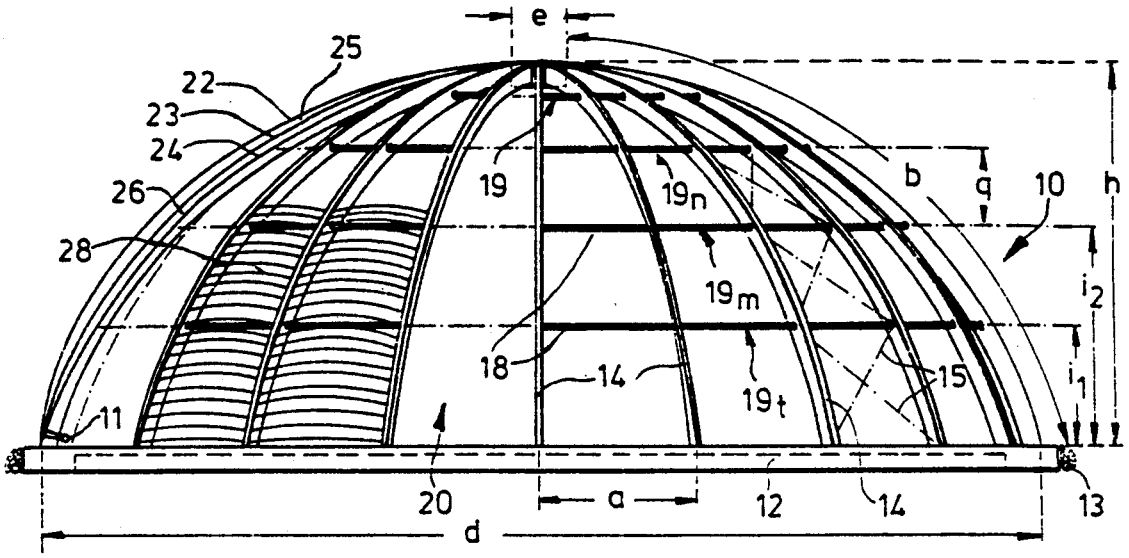
FIG. 1 is a diagrammatic side view of a part-spherical roofing with arcuate frame members.

A swimming pool (not shown), a horticultural area or the like is covered by a roof dome 10 of a diameter d at ground level of 40 meters in the illustrated embodiment. It rests on a bedplate indicated at 12, with a drainage system 13 extending therearound and a ventilation system 11 disposed thereon.

The roof dome 10 has twenty radially disposed arcuate frame members 14 which determine a part-spherical structure, with an arcuate dimension b of about 25 mm, and with a spacing a relative to each other at ground level of rather more than 6 m.

The arcuate frame members 14 rest with their lower ends on the bed plate 12 and at their other ends are connected to a central roof ring 16, the diameter e of which in this case is 2.25 mm while the upper height h above the bed plate is 15 m. Each two adjacent arcuate frame members 14 form a skin panel 20 which is curved in the curved plane of the part-spherical structure and which is of an upwardly tapering configuration, in the form of an elongated spherical triangle in which four transverse bars 18 extend, being fixed at both ends to the two arcuate frame members 14.

Figure 2:
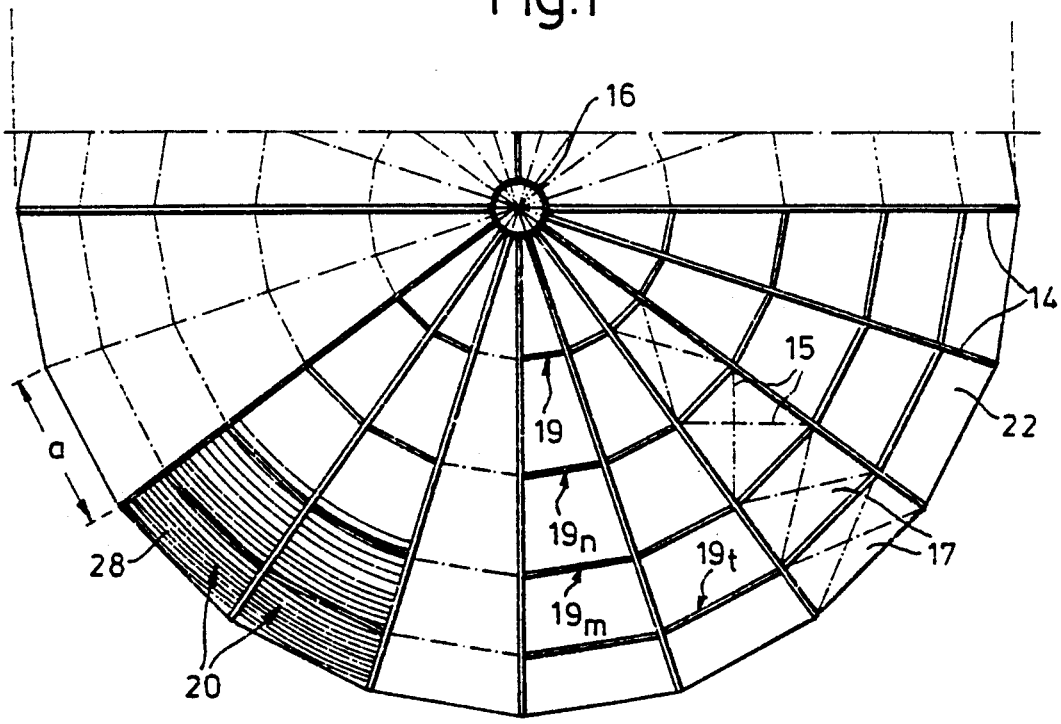
FIG. 2 is a plan view of part of the FIG. 1 construction.
Figure 4:
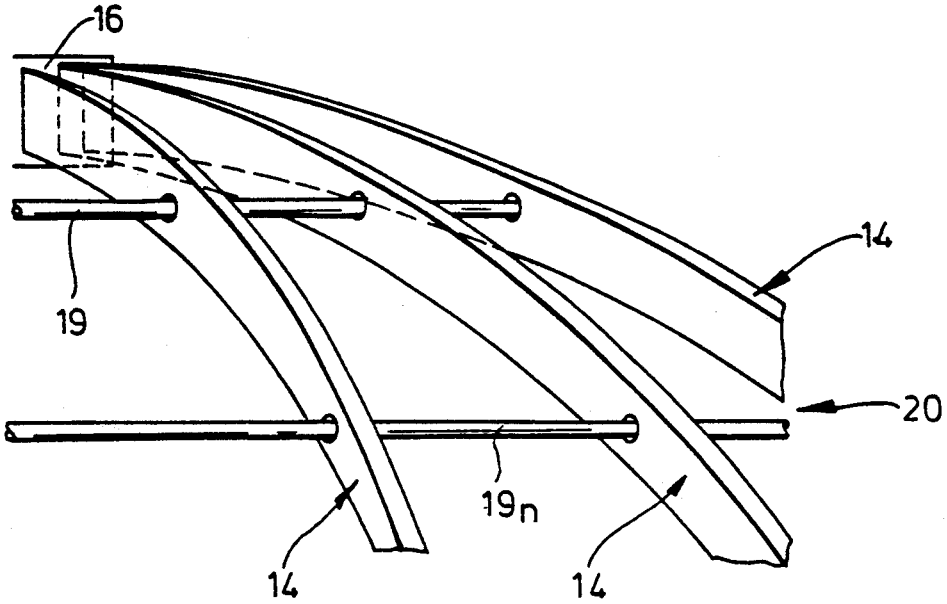
FIG. 4 is a detail from FIG. 1 on a larger scale than FIG. 3.

The spacing $i_1$ from the ground of a ring $19_t$ comprising transverse bars 18 is for example 4.7 m, the spacing $i_2$ from the ground of the next higher ring $19_m$ is about 8.7 m. A further ring $19_n$ is disposed above the ring $19_m$ at a spacing q of 3 m. The four rings 19, $19_n$, $19_m$, $19_t$ which can be seen in FIGS. 1 and 2, with the arcuate frame members 14 which extend across them, define between two frame members 14 four upwardly tapering panels 17, each of which has two mutually crossing diagonal cables 15 extending thereacross; the cables 15 are secured to the locations at which the frame members 14 and transverse bars 18 pass through each other.

Each of the skin panels 20 is made up in a compartmentalized configuration by means of three foils 22, 23 and 24 of translucent material; the foils 22, 23 and 24 are held between their pairs of frame members 14 over the entire arcuate length b thereof.

The three foils 22, 23 and 24 which are arranged in superposed relationship define two air chambers 25 and 26 to which air is supplied at the bottom end. The air is pumped by means of a low-pressure pneumatic system and tensions the foils 22 through 24 and in that way produces a unitary flutter-resistant compartment of large area in the form of a cushion 27 between the pairs of arcuate frame members 14. Reinforcing transverse cables 28 are fitted on to the outer foil 22 and fixed at both ends in the region of the frame members 14.

Figure 6:
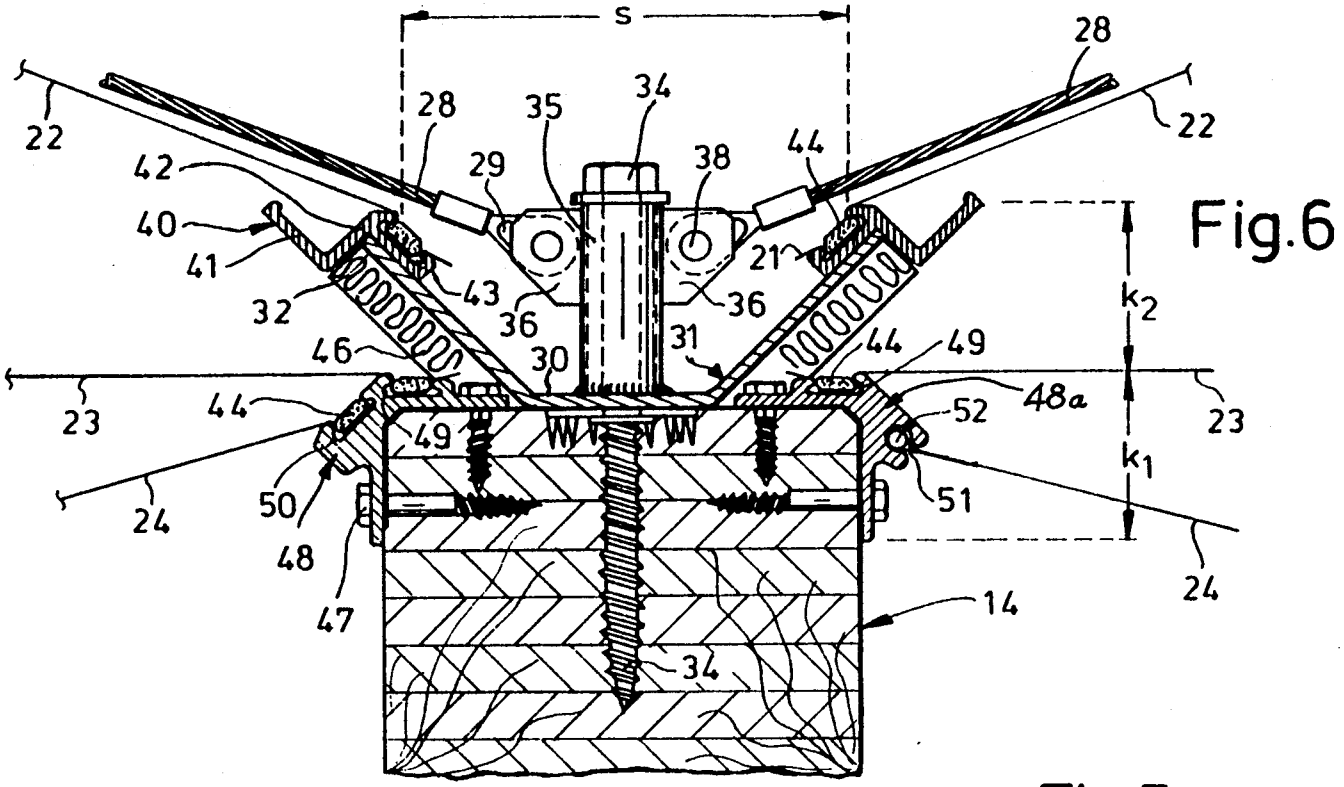
FIG. 6 is a part of the construction in FIG. 5, on an enlarged scale.
Figure 5:
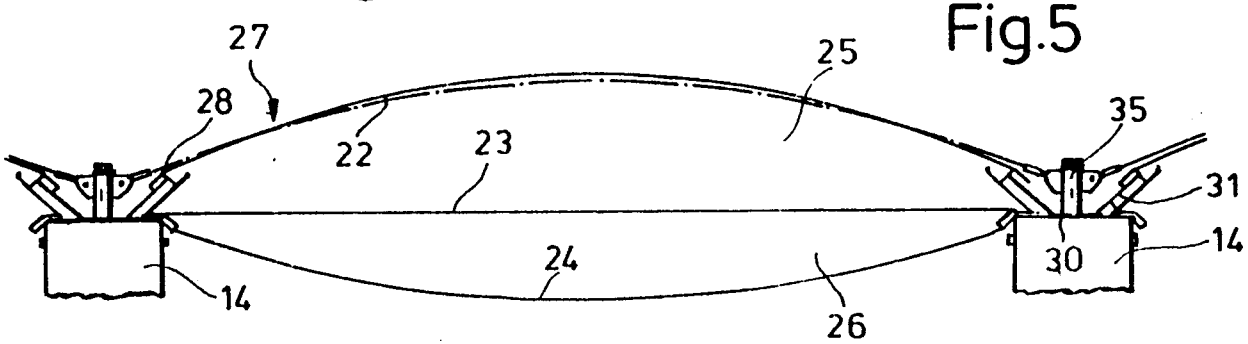
FIG. 5 is a view in section taken along line V—V in FIG. 3 on an enlarged scale.

As shown in FIGS. 5 and 6, the base portion 30 of a shaped metal member acting as a rain drain channel 31 lies on each of the frame members 14, being held in position by fixing screws 34. The fixing screws 34 each pass through a tube portion 35 with wing lugs 36 thereon.

An eye 29 of the transverse cable 28 is pivotally connected to each of the lugs 36 by means of a pin or bolt 38. Tensioning means for the transverse cables 18 and the diagonal cables 15 are not shown in the drawing for the sake of enhanced clarity thereof.

The inclined side limbs 32 of the rain drain channel 31 each carry towards their ends a respective connecting member 40 which is extruded from an aluminum alloy and which in its cross-section comprises a L-shaped condensate catch channel 41 and an adjoining clamping portion 42; in a groove 43 of undercut configuration, the clamping portion 42 accommodates the region of a longitudinal edge 21 of the outer foil 22 and a clamping strip 44. The clamping strip 44 ensures that the tensioned outer foil 22 is held fast in the clamping portion 42 of the connecting member 40. The horizontal spacing s between two outer foils 22 in FIG. 6 is about 200 mm.

Reference numeral 46 indicates an insulating mat which extends at the outside surface of the side limb 32 from the condensate catch channel 41 to a further connecting member 48 which is of an angular configuration and which is fixed to an edge of the arcute frame member 14 and secured by screws 47. In its configuration shown at the left in FIG. 6, the connecting member 48 is provided with two grooves 49, 50 of undercut configuration for connection of the central and inner foils 23 and 24 and for receiving a respective clamping strip 44.

In the other embodiment of the connecting member $48_a$ shown at the right in FIG. 6, the inner foil 24 is provided with a retaining edge 52 which extends in a retaining groove 51 in the connecting member $48_a$ the height $k_1$ thereof is about 70 mm and the spacing $k_2$ thereof from the upper edge of the other connecting member 40 is about 80 mm.

The outer and inner foils 22 and 24 are each about 190 μm in thickness, while the central foil 23 is about 100 μm in thickness. The mean values of the physical properties of the foils used, for a foil thickness of between 90 and 150 μm, are set forth in the following Table:

| Property | | Unit | Value |
|---|---|---|---|
| density | | $g/cm_3$ | 1.75 + 0.05 |
| tearing strength | longitudinally | $N/mm_2$ | 40–50 |
| | transversely | | 40–50 |
| elongation to tearing | longitudinally | % | 300–400 |
| yield stress | longitudinally | $N/mm^2$ | 20–30 |
| | transversely | | 20–30 |
| elongation at yield point | longitudinally | % | 15–20 |
| | transversely | | 15–20 |
| cold fracture temperature | longitudinally | °C. | −180 |
| | transversely | | −180 |
| further tearing strength | longitudinally | N/m | 400–500 |
| with trapezoidal incision | transversely | | 400–500 |

Figures 7, 8, 9, 10:
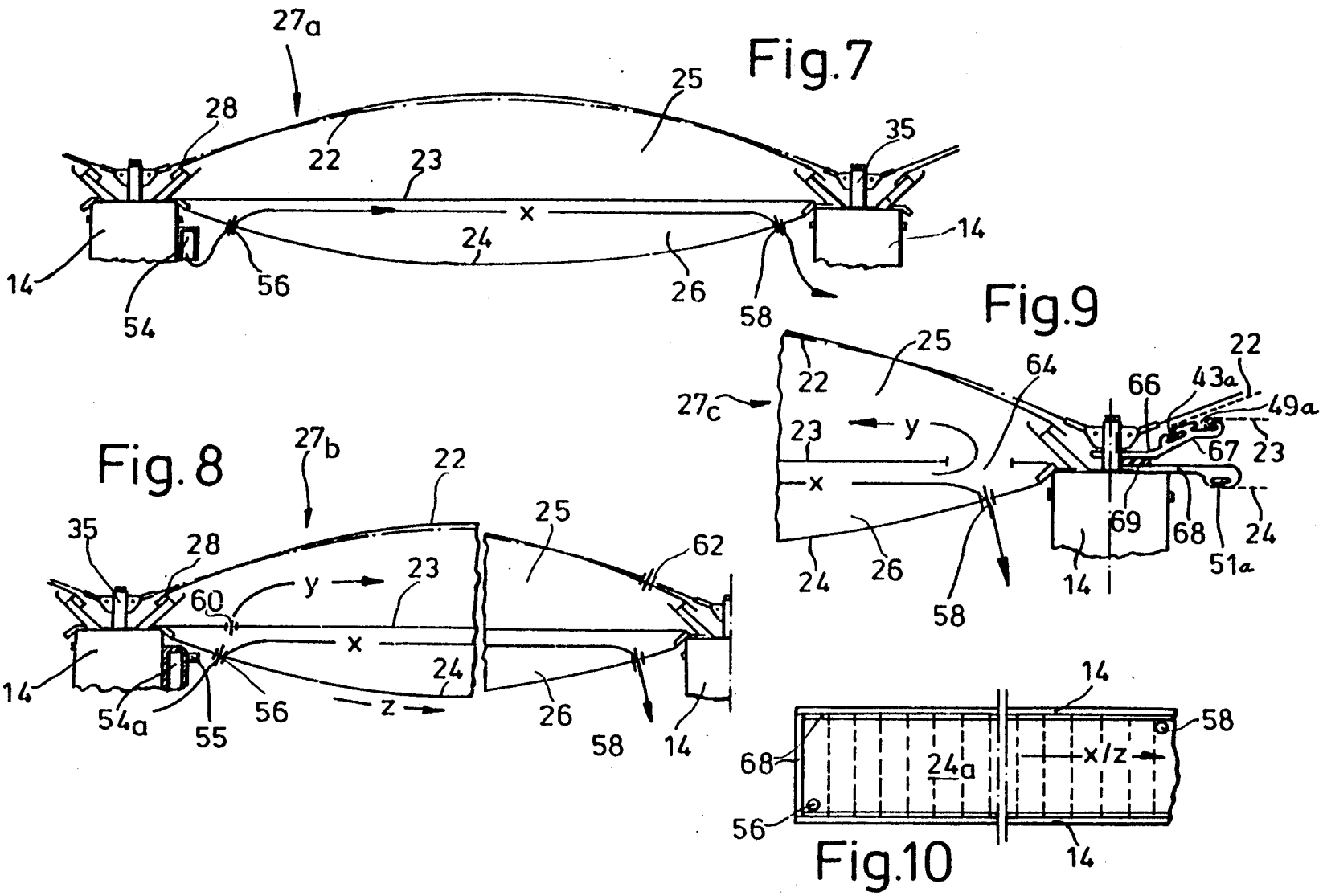
FIGS. 7 through 9 are views corresponding to that shown in FIG. 5 of other embodiments.
FIG. 10 is a view below a part of a roofing configuration with mutually parallel frame members.

FIG. 7 shows an embodiment of a cushion $27_a$ whose outer or upper air chamber 25 contains a stationary or standing filling of air under an increased pressure whereas the inner or lower air chamber 26 has, flowing therethrough, the inside air of the building or fluid medium from an air heating system, as indicated by the arrow x. The alternative air heating system is indicated at 54 and the inlet and outlet valves are indicated at 56, 58. The air pressure in the lower air chamber 26 of preferably 20 mm water column can be controlled by the outlet valve or valves 58.

FIGS. 8 and 9 also show cushion constructions $27_b$ and $27_c$ with flowing air x in the lower air chamber 26. In this case however the upper air chamber 25, in contrast to the above-described cushion $27_a$, as shown in FIG. 8, is connected by a valve 60 in the central foil 23 to the lower air chamber 26 so that a branch flow y of the fluid medium can fill the upper air chamber 25 with controlled air. Reference numeral 62 denotes a normally closed upper connecting valve in the outer foil 22.

In addition to the moving air x or instead thereof, a surface air flow z which is heated at $54_a$, coming from blowing nozzles 55, can be passed along the surface $24_a$ of the inner foil 24, being the surface which is directed towards the ground.

FIG. 9 shows a diaphragm opening 64 in middle foil 23 in place of the above-described valve 60. In addition, shown at the right in FIG. 9 on the frame member 14 which is illustrated therein and which, not being used in a part-spherical roof structure, as shown in FIG. 10, extends in parallel relationship with a further frame member 14 to define an elongated rectangular cushion panel, is a pair of connecting members 66 and 68 which are only indicated at the left-hand side of the frame member. The upper connecting member 66 has grooves $43_a$ and $49_a$ of an undercut configuration, on both sides of a bend line 67. The lower connecting member 68 is carried on the frame member 14 with the interposition of sealing strips 69 and holds the inner foil 24 in its downwardly directed groove $51_a$.

Figure 3:
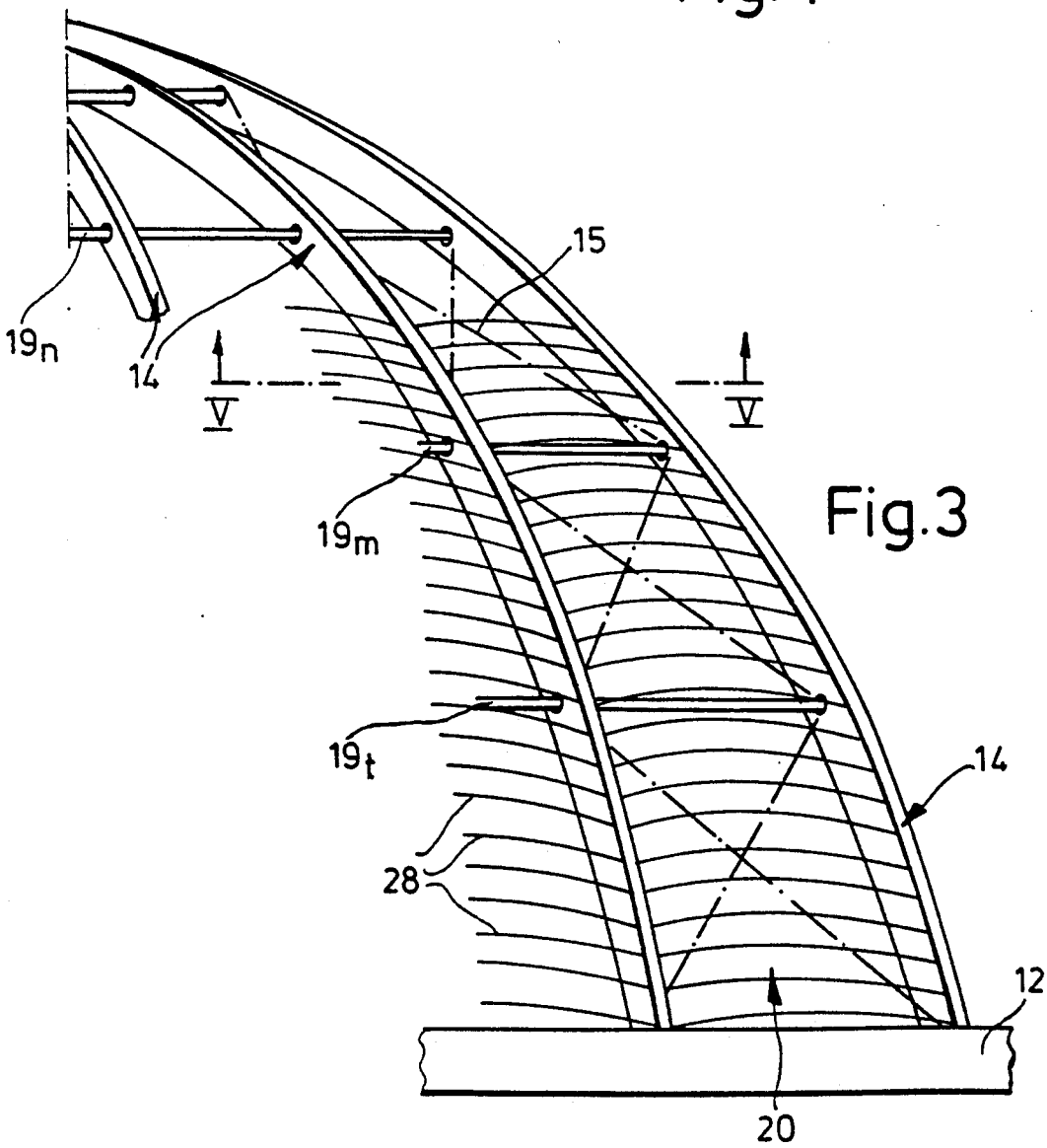
FIG. 3 is a detail from FIG. 1 on an enlarged scale.

FIG. 10 also shows that the connecting members 68, and also the members 40, 48 and 66, are also mounted to the ends of the cushion panels with which the inlet valves 56 and the outlet valves 58 are also associated; the valves 56, 58 and 60, 62 respectively may be provided either on both sides of a cross-section as shown in FIGS. 5, 7 and 8 or at the ends of longer cushion panels as shown in FIGS. 3 and 10.

I claim:

1. A roofed-over building construction which comprises:

a lattice-type space framework including adjacently spaced, extending frame members;

a flexible skin secured to the frame members which can be acted on by a fluid medium comprising at least two foil webs secured to adjacent extending frame members, fixed in superposed relationship, and forming an air-tight chamber therebetween which extends to the frame members;

at least one inlet and outlet for a fluid medium communicating with the air-tight chamber;

at least one central foil between the two foil webs forming a first and second of said air-tight chambers between the at least two foil webs;

said framework including connecting members, wherein each foil is air-tightly secured with its edges releasably connected to said connecting members; and a channel member fixed on the frame member, wherein at least one connecting member is mounted to said channel member.

2. A building construction according to claim 1 wherein the central foil can be acted upon by air and wherein said chambers have an internal pressure that differs from atmospheric pressure.

3. A building construction according to claim 1 wherein said foils are of translucent plastic material.

4. A building construction according to claim 1 including air heating means for heating the fluid medium supplied to the chamber.

5. A building construction according to claim 1 including blowing means beneath the foil webs for producing a flow of air at the foil surface.

6. A building construction according to claim 1 wherein the foils between two frame members form a double-skin air cushion in the form of a spherical triangle.

7. A building construction according to claim 1 wherein the connecting members partially define at least one of said chambers.

8. A building construction according to claim 1 wherein the connecting members are releasably arranged on the frame members.

9. A building construction according to claim 1 wherein said foils are a modified ethylene-tetrafluoroethylene copolymer.

10. A building construction according to claim 1 wherein said foils have a thickness of from 50 μm to 250 μm.

11. A building construction according to claim 1 including fixing screws which stand up from the frame members, wherein mounted to the fixing screws are transverse cables which extend from the fixing screws.

12. A building construction according to claim 1 wherein said second chamber is filled with stationary inflation medium and the said first of said chambers has a fluid medium flowing therethrough between the inlet and the outlet.

13. A building construction according to claim 12 wherein the said second chamber is provided with means communicating with the other chamber through the central foil.

14. A building construction according to claim 13 including valve means associated with the communicating means in the central foil.

15. A building construction according to claim 1 wherein the connecting member has at least two grooves of an undercut configuration which extend at a spacing from each other.

16. A building construction according to claim 15 wherein the connecting member is in the form of an angle portion with extended portions thereof and with a respective groove associated with each extended portion thereof.

17. A building construction according to claim 1 including a connecting element of said framework arranged at a spacing from the ground, wherein the frame members are fixed at one end towards the ground and extend towards said connecting element to which they are connected at their other end.

18. A building construction according to claim 17 wherein the frame members are fixed at the ground in a circular configuration and are curved to said connecting element which forms a central roof ring, said framework forming a part-spherical framework.

19. A building construction according to claim 1 wherein the frame members are connected together by transverse bars.

20. A building construction according to claim 19 including diagonal bracing means mounted on the panels.

21. A building construction according to claim 1, wherein said channel member fixed on the frame member extends thereon in the longitudinal direction.

22. A building construction according to claim 21 including at least one further connecting member fixed to an edge of the frame member at a spacing relative to the upper edge of a first connecting member.

23. A building construction according to claim 21 wherein said channel member has longitudinal edges and wherein at least one connecting member is mounted to each of the longitudinal edges of the said channel member.

24. A building construction according to claim 23 wherein the connecting member has at least one groove of an undercut configuration, and an adjoining, upwardly facing channel portion.

25. A building construction according to claim 24 wherein a respective edge of the foil is sealingly fixed by means of a clamping member in each of the undercut grooves of the connecting member.

* * * * *